United States Patent [19]

Nishitani et al.

[11] Patent Number: 4,808,095

[45] Date of Patent: Feb. 28, 1989

[54] SCREW VACUUM PUMP

[75] Inventors: Kunihiko Nishitani, Akashi; Noboru Tsuboi, Kakogawa, both of Japan

[73] Assignee: Kabushiki Kaisha Kobe Seiko Sho, Kobe, Japan

[21] Appl. No.: 108,702

[22] Filed: Oct. 15, 1987

[30] Foreign Application Priority Data

Jul. 1, 1987 [JP] Japan ..... 62-165042

[51] Int. Cl.[4] ..... F04C 29/04; F04C 2/16

[52] U.S. Cl. ..... 418/15; 418/97; 418/99

[58] Field of Search ..... 418/97, 99, 201, 15

[56] References Cited

U.S. PATENT DOCUMENTS

| | | | |
|---|---|---|---|
| 958,345 | 5/1910 | Wilkin | 418/97 |
| 1,191,423 | 7/1916 | Holdaway | 418/201 |
| 3,112,869 | 12/1963 | Aschoff | 418/99 |
| 3,430,848 | 3/1969 | Turner | 418/99 |
| 3,574,488 | 4/1971 | Vanderstegendrake | 418/15 |
| 4,005,949 | 2/1977 | Grant | 418/15 |
| 4,329,126 | 5/1982 | Nishimura | 418/15 |
| 4,714,418 | 12/1987 | Matsubara | 418/201 |
| 4,727,725 | 3/1988 | Nagata | 418/15 |

FOREIGN PATENT DOCUMENTS

| | | | |
|---|---|---|---|
| 2755328 | 9/1978 | Fed. Rep. of Germany | 418/97 |
| 54-376693 | 3/1979 | Japan . | |
| 122413 | 9/1979 | Japan | 418/99 |
| 57-59920 | 4/1982 | Japan . | |
| 59-185889 | 10/1984 | Japan . | |

*Primary Examiner*—William L. Freeh

*Attorney, Agent, or Firm*—Oblon, Fisher, Spivak, McClelland & Maier

[57] ABSTRACT

A screw vacuum pump which includes a pair of screw rotors meshed with each other. The vacuum pump includes an oilless screw vacuum pump suitable for application to industries where air containing foreign matter is detrimental to the products to be produced and for application to the food industry where odorous air must be avoided.

4 Claims, 4 Drawing Sheets

SCREW VACUUM PUMP

BACKGROUND OF THE INVENTION

1. Title of the Invention:

The present invention relates to a screw vacuum pump having a pair of screw rotors meshed with each other and, more particularly, to an oilless screw pump suitable for application to industries such as the semiconductor industries where air containing foreign matters is detrimental to the products and for application to the industry where odorous air must be avoided.

2. Description of the Prior Art:

Various vacuum pumps including screw vacuum pumps for such applications have been proposed. For example, Japanese Patent Publication No. 54-37693 discloses a water-sealed vacuum pump, Japanese Patent Publication No. 57-59920 discloses a high-vacuum pump, and Japanese Patent Provisional Publication (Kokai) No. 59-185889 discloses a dual shaft vacuum pump.

The oilless screw vacuum pump is one of the desirable pumps. Basically, the screw vacuum pump is of the same construction as the compressor. However, since the screw vacuum pump is used in a situation where the pressure of the suction gas is very low, the compression ratio of the screw vacuum pump, namely, the ratio of the pressure of the discharge gas to that of the suction gas, is very high. For example, the discharge pressure of the vacuum pump, in general, is atmospheric pressure (1.033 ata), while the suction pressure is on the order of 0.1 ata or 0.01 ata. Consequently, the temperature of the discharge gas is elevated to a very high level due to adiabatic compression of the gas. Discharge gas temperature Td (°K) is expressed by $$Td = Ts\,(P2/P1)^{(\kappa-1)/\kappa}$$

where P1 is suction pressure, P2 is discharge pressure, Ts (°K) is suction gas temperature, and $\kappa$ (1.4 for air) is the specific heat of the gas. Accordingly, in the vacuum pump, the compression ratio P2/P1 is very large when the suction pressure is on the order of 0.01 or 0.001 torr, and hence the discharge gas temperature Td is elevated to a very high level. For example, in such air ($\kappa = 1.4$) of an ordinary temperature of 30° C. (303° K.) by the vacuum pump, the discharge gas temperature Td is 317° C. (590° K.) and 867° C. (1140° K.) when the suction pressure P1 is 0.1 ata (76 torr) and 0.01 ata (7.6 torr), respectively. Thus, the vacuum pump exerts a relatively small amount of work on the gas, but elevates the temperature of the gas to a considerably high level.

To suppress a rise in temperature of the gas, the water-sealed vacuum pump or the high-vacuum pump, the gas is brought into direct contact with water or oil while the gas flows from the suction port to the discharge port so that the gas and the vacuum pump is cooled. However, such vacuum pump suffers from the leakage of water or oil in the suction side and the reverse flow of water or oil in case the vacuum pump is stopped suddenly or when the power supply is interrupted accidentally. Accordingly, such vacuum pump is inapplicable to the semiconductor industries and the food industries for the above-mentioned reasons.

There has been proposed an oilless dual shaft vacuum pump which brings the gas in contact with neither water nor oil. In this specification, "oilless" means not requiring oil or water which is to be brought into contact with the gas while the gas flows through the vacuum pump. The oilless dual shaft vacuum pump is applicable for operation at a vacuum in a medium vacuum range. However, since the rotors of the oilless dual shaft vacuum pump must be positioned with a gap therebetween, the leakage of the gas through the gap between the rotors increases when the oilless dual shaft vacuum pump is applied for operation in a low vacuum range.

SUMMARY OF THE INVENTION

The present invention has been proposed to solve the above-noted problems in the conventional vacuum pumps.

Accordingly, it is a principal object of the present invention to provide a single-stage oilless screw vacuum pump capable of satisfactorily functioning in a wide vacuum range from a low vacuum to a high vacuum.

Accordingly to one aspect of the present invention, an oilless screw vacuum pump comprises a casing having a rotor chamber having one end opening into a suction port and the other end opening into a discharge port, and cooling gas supply bores formed through the wall of the rotor chamber so as to open into closed spaces in the rotor chamber and so as not to communicate with either the suction port or the dischrge port; and a set of screw rotors rotatably disposed in the rotor chamber so as to be meshed with each other.

According to another aspect of the present invention, an oilless screw vacuum pump comprises a casing having a rotor chamber having one end opening into a suction port and the other end opening into a discharge port, and a cooling gas supply bore formed through the wall of the rotor chamber so as to open into the atmosphere and into the rotor chamber at a position where the average pressure of the gas is lower than the pressure of the same at the discharge port; a pair of screw rotors rotatably disposed in the rotor chamber so as to be meshed with each other.

According to the present invention, a cooling gas is supplied into the fixed rotor wall chamber without using any gas supply means to directly cool the gas being compressed so that a rise in the temperature of the gas is suppressed effectively.

BRIEF DESCRIPTION OF THE DRAWINGS

The above and other objects, features and advantages of the present invention will become apparent from the following description taken in conjunction with the accompanying drawings, in which.

DESCRIPTION OF THE PREFERRED EMBODIMENTS

Figure 1:
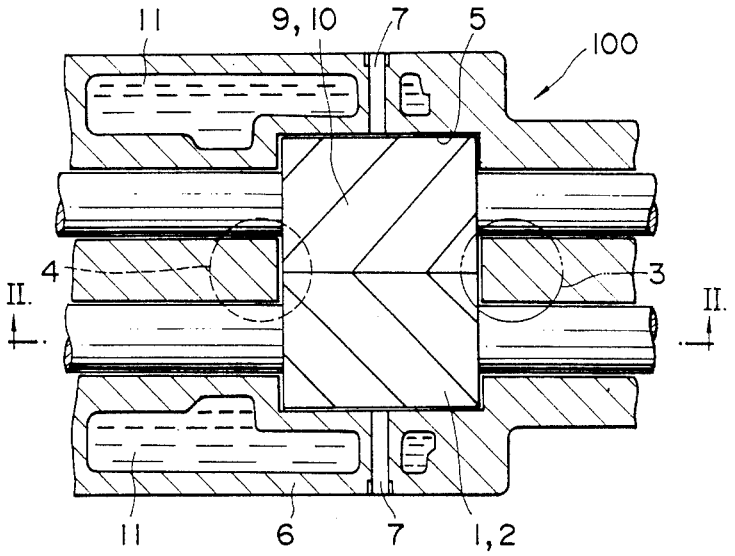
FIG. 1 is fragmentary longitudinal sectional view of a screw vacuum pump, in a first embodiment, according to the present invention.
Figure 2:
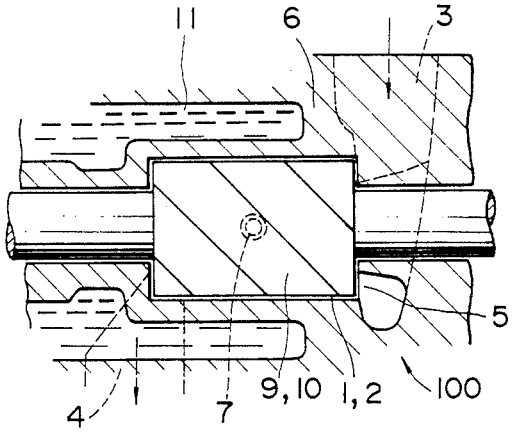
FIG. 2 is a sectional view taken on line II—II in FIG. 1.

Referring to FIGS. 1 and 2 showing a first embodiment, generally indicated at 100 is an oilless screw vacuum pump comprising a casing 6 having a rotor chamber 5 and a water jacket 11, and a pair of screw rotors 1 and 2 rotatably disposed in the rotor chamber 5 and meshed with each other. The rotor chamber 5 communicates at one end with a suction passage 3 and at the other end with a discharge passage 4. The helical grooves 9 and 10 of the screw rotors 1 and 2 each sequentially takes on three transient states, namely, a suction state in which the helical groove is open into the suction passage 3, a sealed state in which the helical groove defines a sealed space communicating with neither the suction passage 3 nor the discharge passage 4 between the wall thereof and the inner surface of the rotor chamber 5 and a discharge state in which the helical groove communicates with the discharge passage 4, as the screw rotors 1 and 2 are rotated. Accordingly, the screw vacuum pump 100 has, as a constructional feature specific to screw vacuum pumps, sealed spaces which are always in a sealed state in the rotor chamber 5. Cooling gas supply bores 7 are formed through the wall of the casing 6 so as to open into the sealed spaces, respectively, and into the atmosphere. Air of a temperature (i.e., an ordinary temperature) far lower than that of the gas being compressed in the rotor chamber 5 is supplied through the cooling gas supply bores 7 into the sealed spaces only by the agency of the difference between the atmospheric pressure and the pressure prevailing in the sealed spaces to cool the gas being compressed. The water jacket surrounding the cooling gas supply bores 7 cools the air flowing through the cooling gas supply bores 7 to enhance the cooling effect of the air.

Generally, the pressure in the sealed spaces of a screw compressor for compressing a gas is higher than the atmospheric pressure. Therefore, it is impossible to supply air into the sealed spaces of the screw compressor only by the pressure difference between the sealed spaces and the atmosphere even if such cooling gas supply bores are formed in the casing. The force supply of air through the cooling gas supply bores into the sealed spaces in the rotor chamber requires an additional device, which increases the power consumption rate of the screw compressor to disadvantage.

However, since the sealed spaces in the rotor chamber 5 of the screw vacuum pump are always shut off from the discharge passage 4 communicating with the atmosphere and is always in a vacuum state, air can be supplied into the sealed spaces without requiring any power. Furthermore, since the sealed spaces are in a vacuum state, only a negligibly small power is necessary for compressing the gas, and hence an increase in power consumption rate of the screw vacuum pump attributable to the supply of cooling air into the sealed spaces is not a significant problem.

When the interior of the rotor chamber 5 is in a vacuum state, the cooling effect of the water jacket 11 for cooling the gas and the screw rotors 1 and 2 is insignificant. Since the air supplied into the sealed spaces in the rotor chamber 5 serves as a heat transfer medium, the air supplied into the sealed spaces enhances the cooling effect of the water jacket 11 in addition to directly cooling the gas being compressed by the agency of the temperature difference.

Still further, owing to a constructional feature specific to the screw vacuum pump, the sealed spaces never communicate with the suction passage 3, and the supply of air through the cooling gas supply bores 7 into the sealed spaces never affects the vacuum on the side of the suction passage 3.

A flow regulating device, such as a needle valve, may be provided at the entrance of the cooling gas supply bore 7 to regulate the flow rate of air through the cooling gas supply bore 7.

Figure 3:
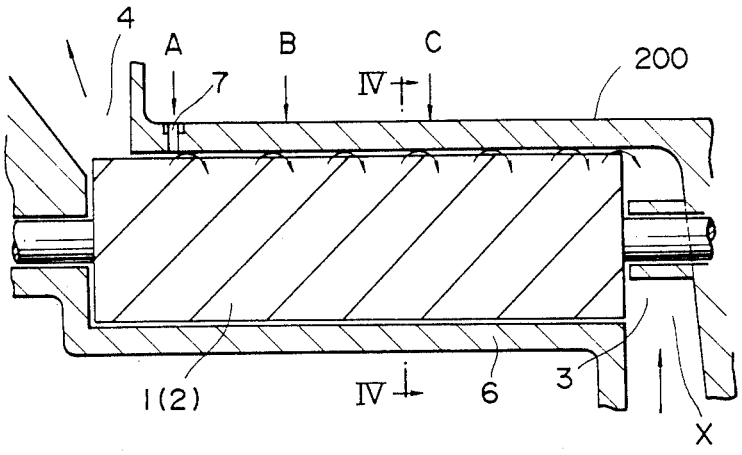
FIG. 3 is a fragmentary longitudinal sectional view of a screw vacuum pump, in a second embodiment, according to the present invention.
Figure 4:
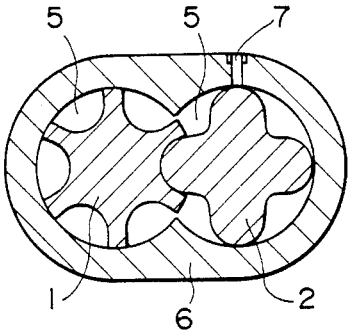
FIG. 4 is a sectional view taken on line IV—IV in FIG. 3.

Referring to FIGS. 3 and 4 illustrating a second embodiment, an oilless screw vacuum pump 200, according to the present invention incorporates a further improvement. The oilless screw vacuum pump 200 comprises a casing 6 having a rotor chamber 5 having one end communicating with a suction passage 3 and the other end communicating with a discharge passage 4, and a pair of screw rotors 1 and 2 rotatably disposed in the rotor chamber 5 and meshed with each other.

Figure 5:
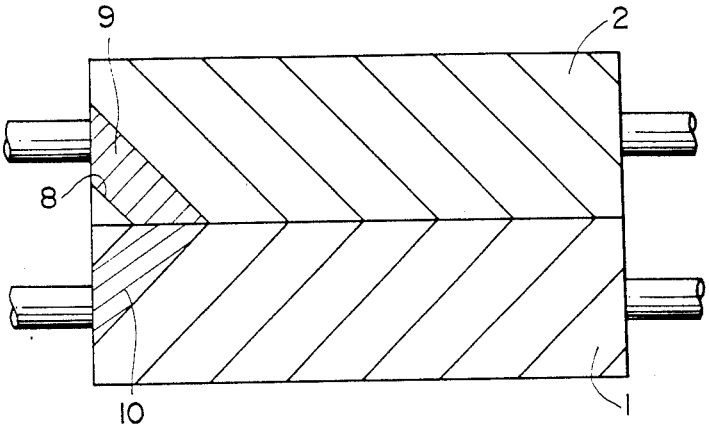
FIG. 5 is a plan view for explaining the positional relationship between the discharge port and the screw rotors of the screw vacuum pump of FIG. 3

A cooling gas supply bore 7 is formed through the wall of the casing 6. The cooling gas supply bore 7 has one end opening into the atmosphere and the other end opening into the rotor chamber 5 at a position A which communicates with the discharge passage 4 and at which the average pressure of the gas is lower than the pressure of the gas prevailing in the discharge passage 4. More particularly, the other end of the cooling gas supply bore 7 opens into the rotor chamber 5 at a position in a shaded section shown in FIG. 5, where the boundary between the respective grooves 9 and 10 of the screw rotors 1 and 2 on the side of the discharge passage 4 coincides with the discharge port 8 (FIG. 5).

The effects of the cooling gas supply bore 7 on the function of the screw vacuum pump and the dependence of the effects on the position of the cooling gas supply bore 7 will be explained hereinafter.

When air flows through the cooling gas supply bore 7 into the sealed space defined by the groove 9 of the screw rotor 2, the pressure in the sealed space rises according to the amount of air that flows into the sealed space. Consequently, some part of the air leaks into the suction passage 3 to diminish the reachable vacuum on the suction side. Obviously, the degree of diminution in the reachable vacuum is smaller when the cooling gas supply bore 7 is formed at the position A than when the cooling gas supply bore 7 is formed at a position C which is nearer to the suction passage 3 than the position A, because the air supplied into the sealed space must pass more barriers than those in a range from the position C to the suction passage 3 in flowing from the position A to the suction passage 3.

Figure 6:
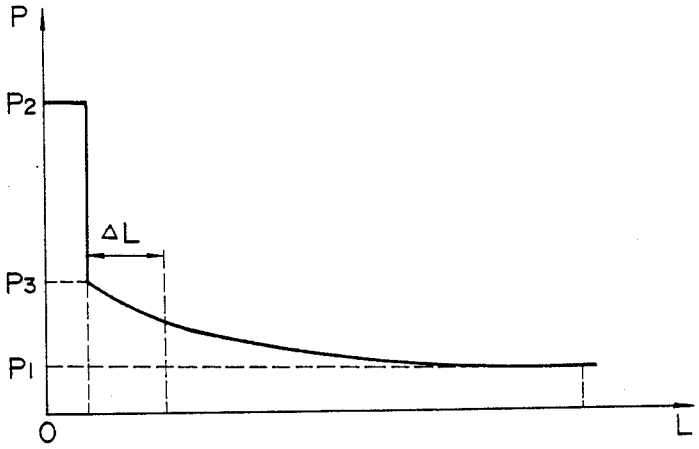
FIG. 6 is a graph showing pressure distributions inside and outside the rotor chamber of the screw vacuum pump of FIG. 3.

FIG. 6 shows the pressure distribution in the rotor chamber 5, in which pressure P is measured on the vertical axis and the distance L from the end surface of the rotors on the discharge side is measured on the horizontal axis. As is apparent from FIG. 6, pressure in a range $\Delta L$ corresponding to the shaded area in FIG. 5 is lower than the atmospheric pressure, so that cooling air is able to flow through the cooling gas supply bore 7 into the rotor chamber 5.

The relation between the suction pressure P1 and the discharge pressure P2 is expressed by: $P1 = P1 \times \pi i$, where $\pi i$ is an internal pressure ratio uniquely dependent on the size of the discharge port 8. For example, theoretically, $P3 = 0.5$ torr when $P1 = 0.05$ torr and $\pi i = 10$. Actually, air under atmospheric pressure, namely, 760 torr, flows into the shaded area (FIG. 5) when the groove of the screw rotor communicates when the atmosphere and hence the pressure P3 at the discharge port 8 is higher than the pressure P1·$\pi$i. However, since the pressure P3 is far lower than the atmospheric pressure, air is able to flow through the cooling gas supply bore 7 into the rotor chamber 5. Thus, the cooling gas supply bore 7 is formed at a farthest possible position from the suction passage 3 and allows the spontaneous flow of air through the cooling gas supply bore 7 into the rotor chamber 5 to suppress the leakage of the air into the suction passage 3.

Figure 7:
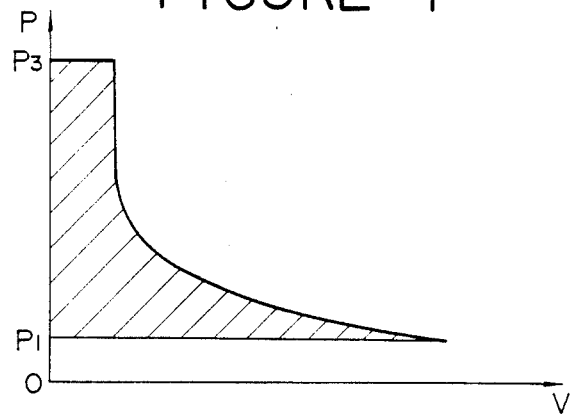
FIGS. 7, 8 and 9 are graphs showing general PV diagrams for vacuum pumps.
Figure 8:
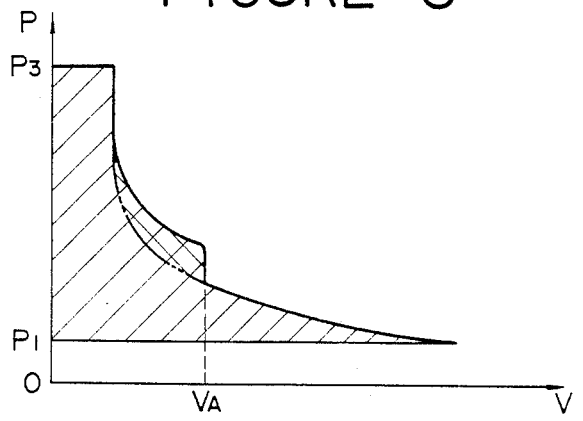
Figure 9:
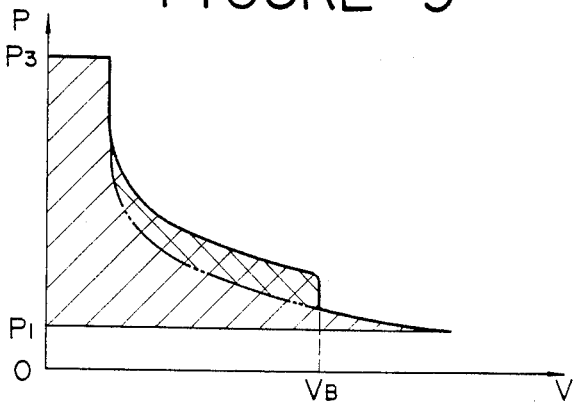

FIGS. 7 to 9 are PV diagrams for screw vacuum pumps which are different from each other with respect to the position of the cooling gas supply bore 7, in which the volume V of spaces defined by the grooves of the screw rotors is measured on the horizontal axis and pressure P in the spaces defined by the grooves of the screw rotors is measured on the vertical axis. In FIGS. 7 to 9, shaded areas including double shaded areas represent necessary power of the vacuum pumps. FIGS. 7, 8 and 9 are for a screw vacuum pump without the cooling gas supply bore 7, a screw vacuum pump having the cooling gas supply bore 7 at the position A, and a screw vacuum pump having the cooling gas supply bore 7 at the position B. In FIGS. 8 and 9, $V_A$ and $V_B$ indicate the volumes of the gas at the positions A and B, respectively. The PV characteristics of a screw vacuum pump having the cooling gas supply bore 7 at the position C is similar to those of the screw vacuum pump having the cooling gas supply bore 7 at the position B, and hence a description thereof is omitted.

In FIGS. 8 and 9, double shaded areas each represents an increment of necessary power due to the air that flows through the cooling gas supply bore 7 into the rotor chamber. Obviously, the nearer the position of the cooling gas supply bore 7 to the discharge passage 4, the less the increase in necessary power.

Although the cooling gas supply bore 7 is provided only on the side of the screw rotor 2 in the second embodiment, two cooling gas supply bores may be formed on both sides of the screw rotors 1 and 2 or more than two cooling gas supply bores may be formed in the casing.

Furthermore, the cooling gas to be supplied through the cooling gas supply bore 7 is not limited to air; any suitable gas may be supplied through the cooling gas supply bore 7. For example, in evacuating an inflammable gas such as methanol gas or acetone gas, nitrogen gas or the like may be supplied through the cooling gas supply bore 7 to prevent an explosion in addition to lowering the temperature of the discharged gas.

Although the invention has been described in its preferred forms with a certain degree of particularity, many changes and variations are possible in the invention in the light of the above teachings. It is therefore to be understoood that the present invention may be practiced within the scope of the appended claims otherwise than as specifically described.

What is claimed is:

1. A screw vacuum pump, comprising:

a casing having a fixed wall rotor chamber having a first axial end thereof opening into a suction passage and a second axial end thereof opening into a discharge passage; and a pair of screw rotors rotatably provided in the rotor chamber of said casing so as to be meshed with each other; wherein said casing has a cooling gas supply bore for supplying a cooling gas under atmospheric pressure from an external cooling gas source into the rotor chamber formed so as to open into a sealed spaced defined by a helical groove of one of said pair of screw rotors and an inner surface of the rotor chamber and out of communication with said suction passage wherein said helical groove sequentially takes on three transient states, a suction state in which the helical groove is open into the suction passage, a sealed state in which the helical groove defines a sealed space communicating with neither the suction passage nor the discharge passage between a wall thereof and the inner surface of the rotor chamber, and a discharge state in which the helical groove communicates with the discharge passage, as said pair of screw rotors are rotated.

2. A screw vacuum pump, comprising:

a casing having a fixed wall rotor chamber having a first axial end opening into a suction passage and a second axial end opening into a discharge passage; and a pair of screw rotors rotatably provided in the rotor chamber of said casing so as to be meshed with each other and having at least one helical groove formed thereon; wherein said casing has a plurality of cooling gas supply bores for supplying a cooling gas under atmospheric pressure from an external cooling gas source into the rotor chamber formed so as to open into sealed spaces defined by said at least one groove of said pair of screw motors and an inner surface of the rotor chamber and out of communication with said suction passage, respectively, wherein said helical groove sequentially takes on three transient states, a suction state in which the helical groove is open into the suction passage, a sealed state in which the helical groove defines a sealed space communicating with neither the suction passage nor the discharge passage between a wall thereof and the inner surface of the rotor chamber, and a discharge state in which the helical groove communicates with the discharge passage, as said pair of screw rotors are rotated.

3. A screw vacuum pump, comprising:

a casing having a fixed wall rotor chamber having a first axial end opening into a suction passage and a second axial end opening into a discharge passage; and a pair of screw rotors rotatably provided in the rotor chamber of said casing so as to be meshed with each other and having at least one groove formed therein; wherein said casing has a plurality of cooling gas supply bores for supplying a cooling gas under atmospheric pressure from an external cooling gas source into the rotor chamber formed therein so as to open into sealed spaces defined by said at least one groove of said pair of screw rotors and an inner surface of the rotor chamber and out of communication with both the suction passage and the discharge passage, respectively, wherein said helical groove sequentially takes on three transient states, a suction state in which the helical groove is open into the suction passage, a sealed state in which the helical groove defines a sealed space communicating with neither the suction passage nor the discharge passage between a wall thereof and the inner surface of the rotor chamber, and a discharge state in which the helical groove communicates with the discharge passage, as said pair of screw rotors are rotated.

4. A screw vacuum pump, comprising:

a casing having a fixed wall rotor chamber having a first axial end opening into a suction passage and a second axial end opening into a discharge passage; and a pair of screw rotors rotatably provided in the rotor chamber of said casing so as to be meshed with each other and having at least one helical groove formed therein; wherein said casing has a cooling gas supply bore for supplying a cooling gas under atmospheric pressure from an external cooling gas source into the rotor chamber formed therein so as to open into a space where an average pressure of the gas being pumped is lower than a pressure prevailing in the discharge passage wherein said helical groove sequentially takes on three transient states, a suction state in which the helical groove is open into the suction passage, a sealed state in which the helical groove defines a sealed space communicating with neither the suction passage nor the discharge passage between a wall thereof and the inner surface of the rotor chamber, and a discharge state in which the helical groove communicates with the discharge passage, as said pair of screw rotors are rotated.

* * * * *